US010865674B2

(12) United States Patent
Cho

(10) Patent No.: US 10,865,674 B2
(45) Date of Patent: Dec. 15, 2020

(54) EXHAUST GAS HEAT EXCHANGER CAPABLE OF CONTROLLING COOLING PERFORMANCE

(71) Applicants: KORENS CO., LTD., Yangsan-si (KR); BMW AG, Munich (DE)

(72) Inventor: Hyung Geun Cho, Busan (KR)

(73) Assignees: KORENS CO., LTD., Yangsan-si (KR); BMW AG, Munich (DE)

( * ) Notice: Subject to any disclaimer, the term of this patent is extended or adjusted under 35 U.S.C. 154(b) by 37 days.

(21) Appl. No.: 16/466,744

(22) PCT Filed: Sep. 26, 2017

(86) PCT No.: PCT/KR2017/010633
§ 371 (c)(1),
(2) Date: Jun. 5, 2019

(87) PCT Pub. No.: WO2018/117378
PCT Pub. Date: Jun. 28, 2018

(65) Prior Publication Data

US 2020/0072104 A1 Mar. 5, 2020

(30) Foreign Application Priority Data

Dec. 19, 2016 (KR) ..... 10-2016-0173809

(51) Int. Cl.

| | |
|---|---|
| ***F01N 3/02*** | (2006.01) |
| ***F01N 3/04*** | (2006.01) |
| ***F01N 13/08*** | (2010.01) |
| ***F01P 3/12*** | (2006.01) |
| ***F02D 9/04*** | (2006.01) |

(52) U.S. Cl.
CPC ..... *F01N 3/0205* (2013.01); *F01N 3/043* (2013.01); *F01N 13/08* (2013.01); *F01P 3/12* (2013.01); *F02D 9/04* (2013.01)

(58) Field of Classification Search
CPC ..... F01N 3/0205; F01N 3/043; F01N 13/08; F01P 3/12; F02D 9/04; F02M 26/28; F02M 26/24; F02M 26/25; F02M 26/26; F28D 1/05333
See application file for complete search history.

(56) References Cited

U.S. PATENT DOCUMENTS 7,931,013 B2 4/2011 Castano González

FOREIGN PATENT DOCUMENTS

| | | |
|---|---|---|
| CN | 201568164 | 9/2010 |
| JP | 2014-114728 | 6/2014 |
| KR | 10-2013-0040326 | 4/2013 |
| KR | 10-2013-0073650 | 7/2013 |

*Primary Examiner* — Mark A Laurenzi
*Assistant Examiner* — Edward Bushard
(74) *Attorney, Agent, or Firm* — Lex IP Meister, PLLC

(57) ABSTRACT

The present invention relates to an exhaust gas heat exchanger capable of controlling the cooling performance. The exhaust gas heat exchanger includes: a cooler through which cooling water flows and in which a plurality of gas tubes is provided to allow exhaust gas to flow; an intake and exhaust block including an intake part, a supply line, a discharge line, a bypass line, and a first flap; a U-turn block including an inflow part, a re-cooling line, a release line, and a second flap; and an air duct.

2 Claims, 5 Drawing Sheets

[Fig. 1]
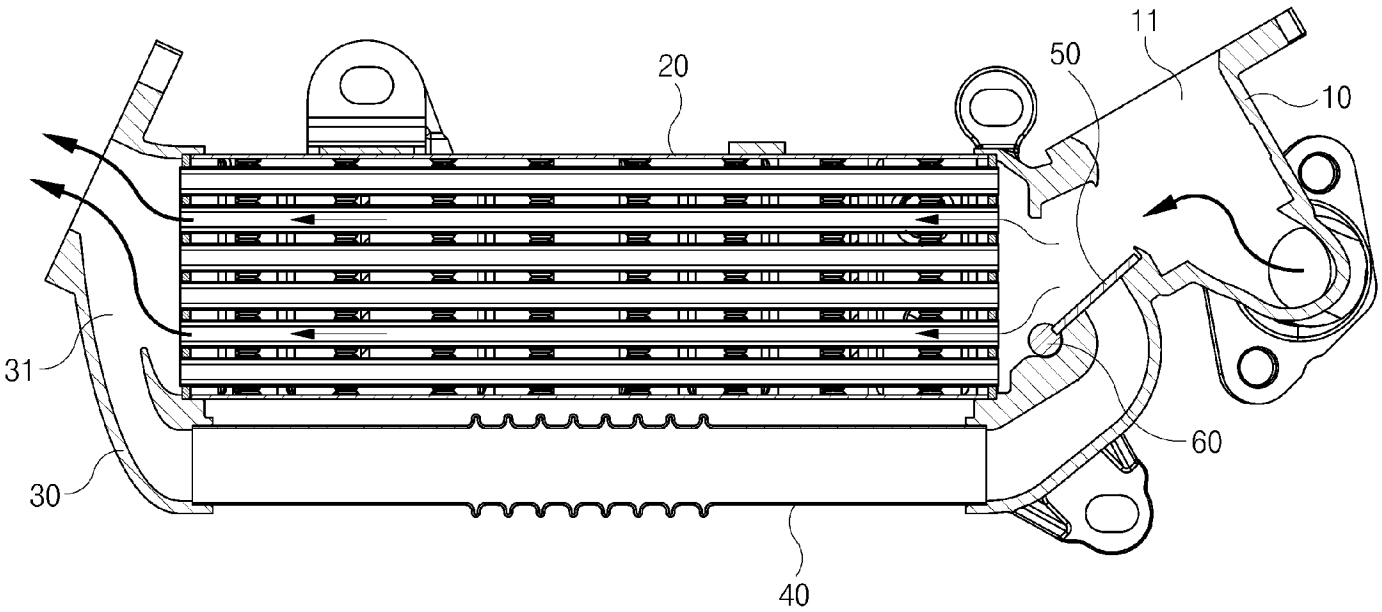

[Fig. 2]
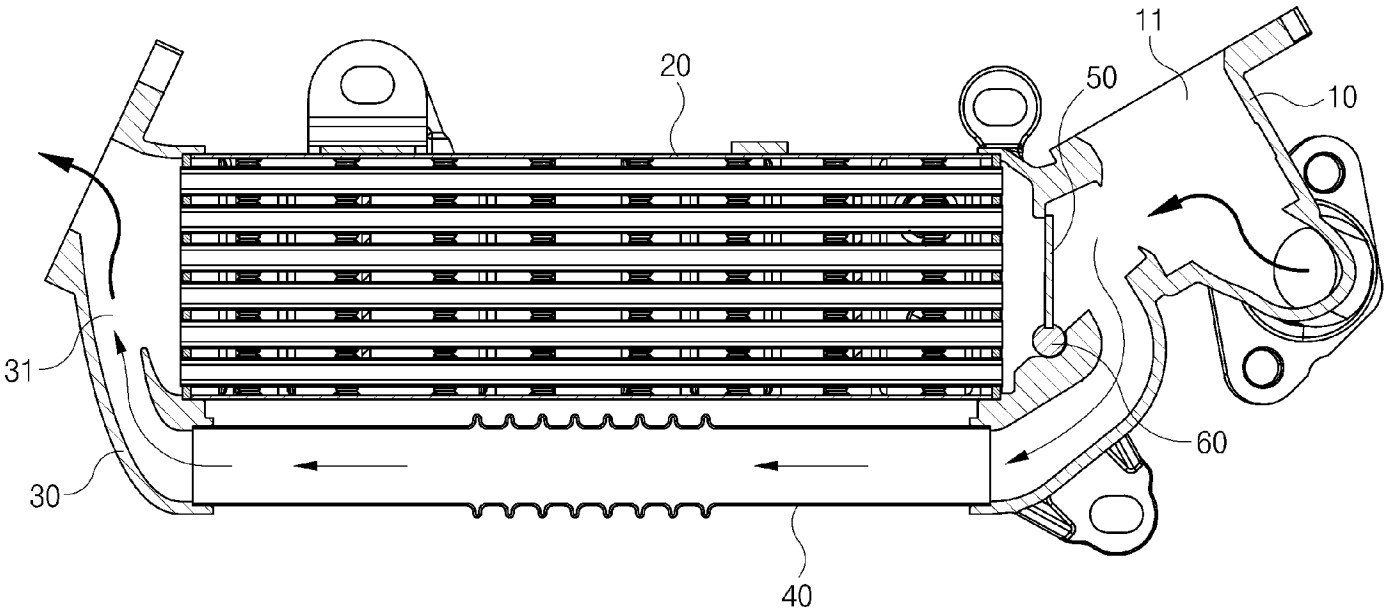

[Fig. 3]
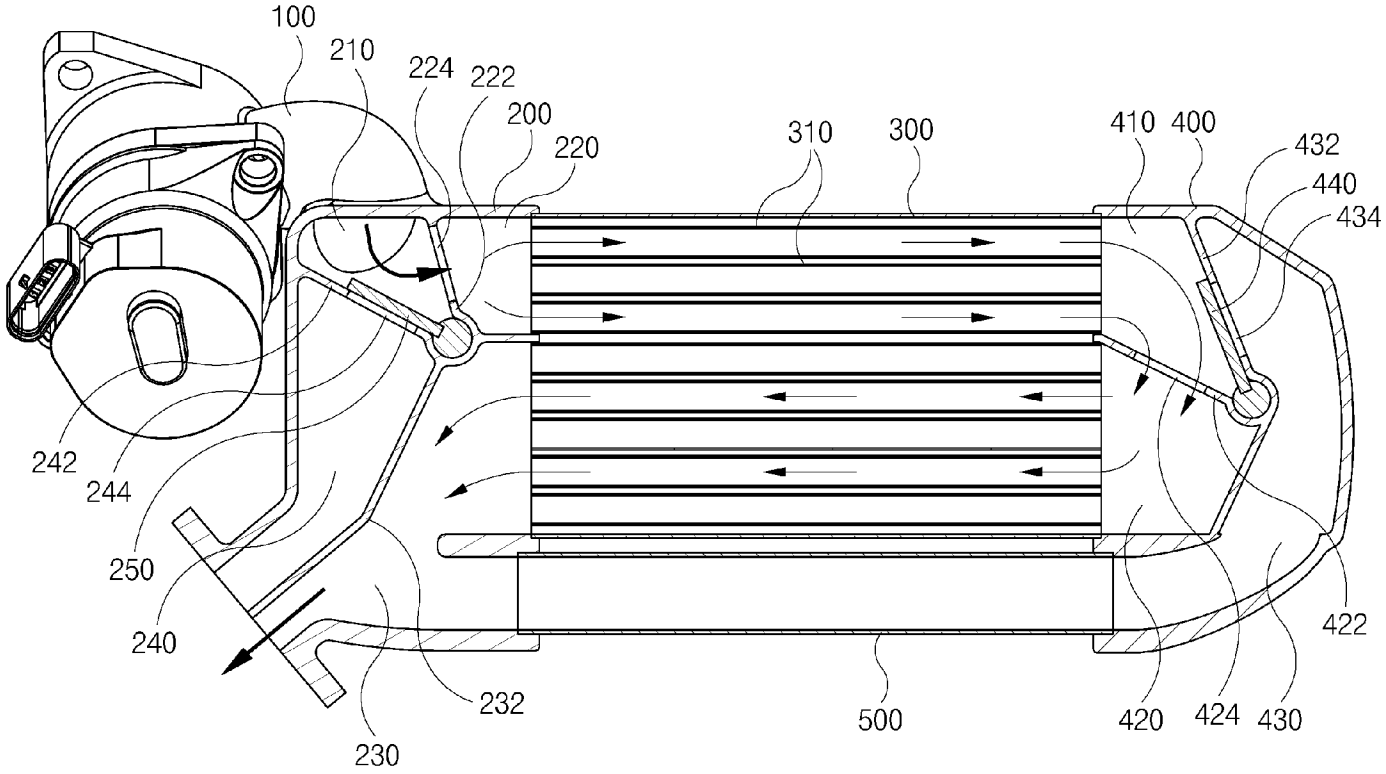

[Fig. 4]
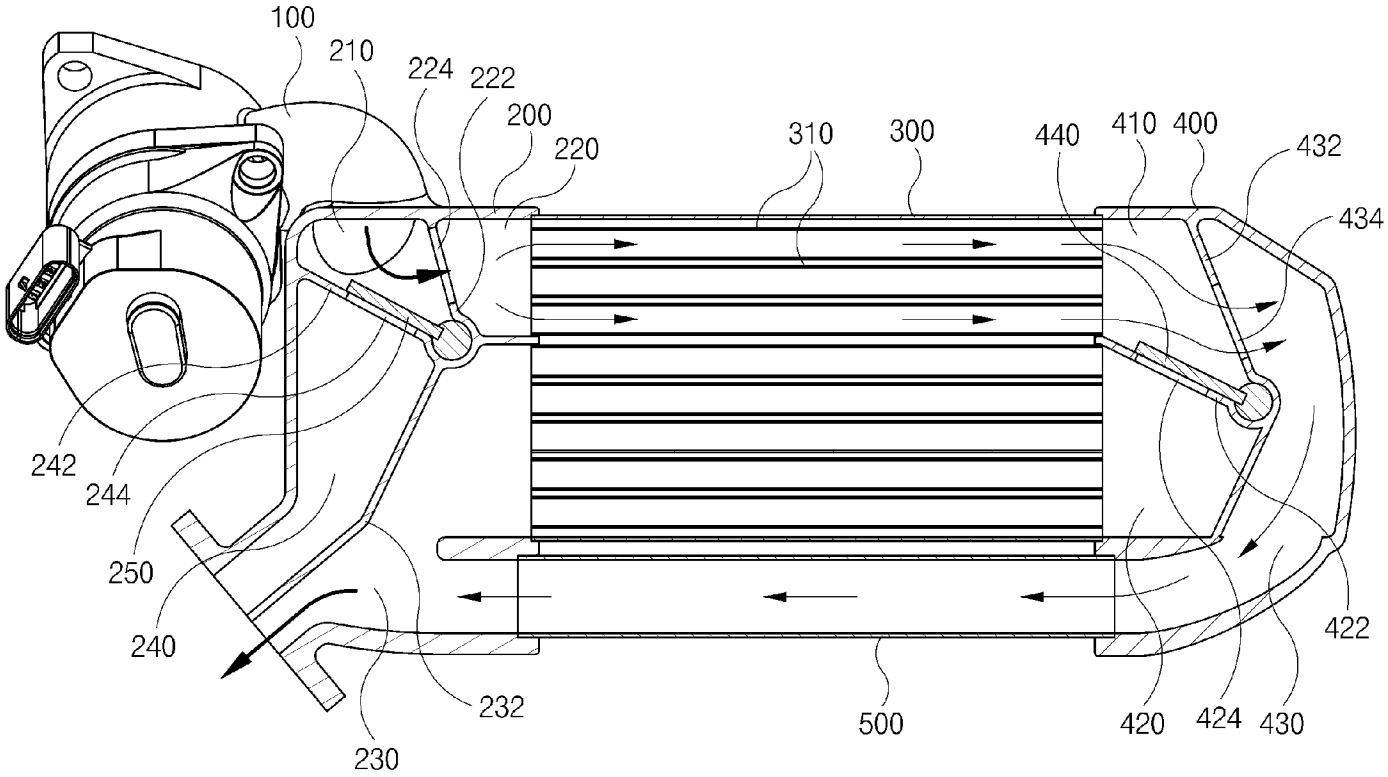

[Fig. 5]
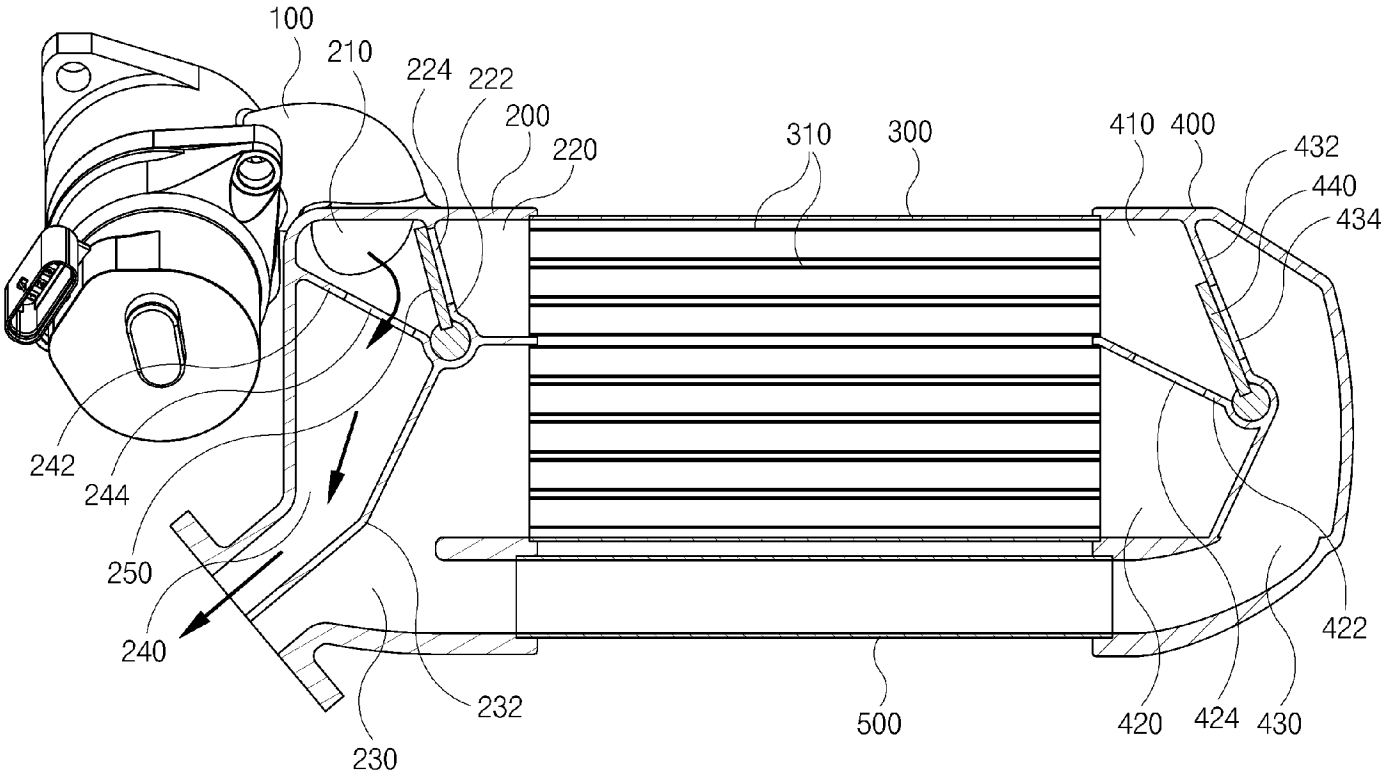

EXHAUST GAS HEAT EXCHANGER CAPABLE OF CONTROLLING COOLING PERFORMANCE

TECHNICAL FIELD

The present invention relates to an exhaust gas heat exchanger, which is configured to cool a part of exhaust gas of an engine by a cooler and re-supply the cooled exhaust gas to the engine, or to bypass a part of exhaust gas of the engine and directly re-supply the bypassed exhaust gas to the engine. More particularly, the present invention relates to an exhaust gas heat exchanger capable of controlling the cooling performance for cooling exhaust gas.

BACKGROUND ART

Generally, exhaust gas of a vehicle is generated during combustion of mixed gas and is discharged to the outside through an exhaust pipe of the vehicle, and nitrogen oxides (NOx) in exhaust gas are in inverse proportion to carbon monoxide (CO) and hydrocarbon (HC) in exhaust gas. This means that even when exhaust quantities of CO and HC are greatly reduced due to complete combustion of fuel, a NOx generation amount may be further increased. Therefore, various technologies for reducing pollutants like NOx have been developed.

As the technology for reducing NOx generation amount, an EGR system is well known. In the EGR system a part of exhaust gas is re-circulated to minimize output reduction, and maximum combustion temperature is lowered to reduce the NOx generation amount.

Generally, the EGR system includes a re-circulating pipeline and an EGR cooler, the re-circulating pipeline re-circulating a part of exhaust gas that is discharged from an exhaust manifold to an intake manifold, and the EGR cooler being provided in the re-circulating pipeline to cool the re-circulated exhaust gas. The re-circulating pipeline includes an inlet pipe and an outlet pipe. High-temperature exhaust gas flows into the EGR cooler through the inlet pipe, and exhaust gas cooled in the EGR cooler is discharged through the outlet pipe. In the inlet pipe, a bypass valve assembly for selectively passing and bypassing exhaust gas is provided along with an EGR valve.

Hereinafter, a conventional exhaust gas heat exchanger will be described in detail with reference to the accompanying drawings.

FIGS. 1 and 2 are sectional views showing the conventional exhaust gas heat exchanger.

As shown in FIGS. 1 and 2, the conventional exhaust gas heat exchanger includes: a valve block 10 provided with an exhaust gas flow path 11 into which exhaust gas flows; a rotational shaft 60 mounted to the exhaust gas flow path 11 of valve block 10; a flap 50 fixed to the rotational shaft 60 to allows exhaust gas flowing into the valve block 10 to selectively flow into any one of a cooler 20 and a bypass line 40. Rear ends of the cooler 20 and the bypass line 40 are provided with an exhaust block 30 having an exhaust hole 31. Thus, exhaust gas cooled by the cooler 200 or exhaust gas bypassed through the bypass line 40 is discharged through an outlet 31 and re-circulated to an engine.

As shown in FIG. 1, when the flap 50 is operated to close the bypass line 40 of the exhaust gas flow path 11, exhaust gas flowing into the valve block 10 is cooled to a certain level passing through the cooler 20, and then is re-circulated to the engine. In contrast, when the flap 50 is operated to close the cooler 20 of the exhaust gas flow path 11 as shown in FIG. 2, exhaust gas flowing into the valve block 10 passes through the bypass line 40 and is directly re-circulated to the engine.

The conventional exhaust gas heat exchanger is provided with two modes which are a cooling mode in which exhaust gas flowing into the valve block 10 is cooled by being in contact with all gas tubes of the cooler 20, and a bypass mode in which exhaust gas flowing into the valve block 10 is bypassed without being in contact with the gas tubes of the cooler 20 at all. Therefore, the conventional exhaust gas heat exchanger cannot perform a function of controlling the cooling performance of exhaust gas, that is, a function of slightly cooling exhaust gas.

In the conventional exhaust gas heat exchanger, when temperature or flow of cooling water that flows into the cooler 20 is reduced, the cooling performance for exhaust gas can be reduced to a certain level. However, it is difficult to immediately control the cooling performance for exhaust gas by the method with reducing temperature or flow of cooling water.

DISCLOSURE

Technical Problem

Accordingly, the present invention has been made keeping in mind the above problems occurring in the prior art, and an object of the present invention is to provide an exhaust gas heat exchanger, which is provided with not only a cooling mode and a bypass mode but also a semi-cooling mode so as to control the cooling performance for cooling exhaust gas, wherein the cooling mode is configured to allow exhaust gas to be in contact with all gas tubes in a cooler, the bypass mode is configured to allow the exhaust gas to be completely out of contact with the gas tubes in the cooler, and the semi-cooling mode is configured to allow the exhaust gas to be in contact with some of the gas tubes in the cooler.

Technical Solution

In order to accomplish the above object, the present invention provides an exhaust gas heat exchanger according to the present invention, which includes: a cooler through which cooling water flows and in which a plurality of gas tubes is provided to allow exhaust gas to flow; an intake and exhaust block including an intake part to which an exhaust gas pipe for supplying exhaust gas is connected, with a supply line for communicating first ends of some of the plurality of gas tubes with the intake part, a discharge line for communicating first ends of the remaining tubes of the plurality of gas tubes with outside, a bypass line for bypassing exhaust gas entering from the intake part to the outside, and a first flap for blocking selectively any one line of the supply line and the bypass line; a U-turn block including an inflow part into which exhaust gas discharged through second ends of some of the plurality of gas tubes flows, with a re-cooling line for communicating second ends of the remaining tubes of the plurality of gas tubes with the inflow part, a release line for discharging exhaust gas entering from the inflow part to the outside, and a second flap for blocking selectively any one line of the re-cooling line and the release line; and an air duct for guiding exhaust gas to the discharge line, the exhaust gas being discharged through the release line.

A supply partition having a supply hole may be provided in the supply line.

A bypass partition having a bypass hole may be provided in the bypass line.

The first flap may be rotatably mounted on the intake and exhaust block and operated to cover the supply hole or the bypass hole depending on a rotational angle thereof.

A re-cooling partition having a re-cooling hole may be provided in the re-cooling line.

A release partition having a release hole may be provided in the release line.

The second flap may be rotatably mounted on the U-turn block and operated to cover the re-cooling hole or the release hole depending on a rotational angle thereof.

Outlets of the discharge line and the bypass line may be integrally formed into a single pipe that is divided by a discharge partition.

The number of the gas tubes connected to an outlet of the re-cooling line may be larger than the number of the gas tubes connected to an outlet of the supply line.

Advantageous Effects

As described above, the exhaust gas heat exchanger according to the present invention can control the cooling performance for cooling exhaust gas by having not only the cooling mode in which exhaust gas is in contact with all gas tubes in the cooler to be cooled to the maximum prior to being re-circulated to the engine, and the bypass mode in which the exhaust gas is completely out of contact with the gas tubes of the cooler prior to being re-circulated to the engine, but also the semi-cooling mode in which the exhaust gas is in contact with some of the gas tubes of the cooler to be cooled to a certain level prior to being re-circulated to the engine.

DESCRIPTION OF DRAWINGS

FIGS. 1 and 2 are sectional views showing a conventional exhaust gas heat exchanger.

FIG. 3 is a sectional view showing an exhaust gas heat exchanger according to the present invention when the exhaust gas heat exchanger is in a cooling mode.

FIG. 4 is a sectional view showing the exhaust gas heat exchanger according to the present invention when the exhaust gas heat exchanger is in a semi-cooling mode.

FIG. 5 is a sectional view showing the exhaust gas heat exchanger according to the present invention when the exhaust gas heat exchanger is in a bypass mode.

MODE FOR INVENTION

Hereinafter, an exhaust gas heat exchanger according to an embodiment of the present invention will be described in detail with reference to the accompanying drawings.

FIG. 3 is a sectional view showing the exhaust gas heat exchanger according to the present invention when the exhaust gas heat exchanger is in a cooling mode. FIG. 4 is a sectional view showing the exhaust gas heat exchanger according to the present invention when the exhaust gas heat exchanger is in a semi-cooling mode. FIG. 5 is a sectional view showing the exhaust gas heat exchanger according to the present invention when the exhaust gas heat exchanger is in a bypass mode.

The exhaust gas heat exchanger according to the present invention is configured to be operated as follows. When exhaust gas is re-circulated to an engine in order to reduce NOx included in the exhaust gas, the exhaust gas heat exchanger selectively guides a flow direction of the exhaust gas. Thus, the exhaust gas is supplied to the engine after passing through a cooler 300, or the exhaust gas is directly supplied to the engine without passing through the cooler 300. The exhaust gas heat exchanger of the present invention has a feature to which a semi-cooling mode is added, so that the exhaust gas is cooled to a certain level and then supplied to the engine by passing through some of gas tubes 310 of the cooler 300 in the semi-cooling mode.

That is, the exhaust gas heat exchanger of the present invention includes: the cooler 300 through which cooling water flows and in which a plurality of gas tubes 310 is provided to allow exhaust gas to flow; an intake and exhaust block 200 receiving exhaust gas through an exhaust gas pipe 100 and supplying the exhaust gas to the cooler 300; and a U-turn block 400 transferring exhaust gas that is cooled while passing through the cooler 300 to the intake and exhaust block 200. Exhaust gas supplied to the cooler 300 through the intake and exhaust block 200 is supplied to the U-turn block 400 through some of the gas tubes 310, without passing through all of the gas tubes 310 in the cooler 300. The exhaust gas supplied to the U-turn block 400 is transferred to the intake and exhaust block 200 passing through the remaining gas tubes 310, or not passing through the gas tubes 310, which characterizes the exhaust gas heat exchanger of the present invention.

In order to enable the flow path described above, the intake and exhaust block 200 includes: an intake part 210 connected to the exhaust gas pipe 100; a supply line 220 for communicating each first end of some of the plurality of gas tubes 310 with the intake part 210; a discharge line 230 for communicating each first end of the remaining gas tubes of the plurality of gas tubes 310 with the outside; a bypass line 240 for bypassing exhaust gas flowing into the intake part 210 to the outside; and a first flap 250 for selectively closing any one of the supply line 220 and the bypass line 240.

In addition, the U-turn block 400 includes: an inflow part 410 in which exhaust gas discharged through each second end of some of the plurality of gas tubes 310 flows; a re-cooling line 420 for communicating each second end of the remaining gas tubes of the plurality of gas tubes 310 with the inflow part 410; a release line 430 for discharging exhaust gas that flows through the inflow part 410 to the outside; and a second flap 440 for selectively closing any one of the re-cooling line 420 and the release line 430. In order to straightly transfer exhaust gas discharged through the release line 430 to the intake and exhaust block 200, a separate air duct 500 is provided in the exhaust gas heat exchanger of the present invention to communicate an outlet of the release line 430 with the discharge line 230.

Meanwhile, in order to ensure firm closing of the first flap 250 regarding any one of the supply line 220 and the bypass line 240, a supply partition 222 having a supply hole 224 is provided in the supply line 220, and a bypass partition 212 having a bypass hole 244 is provided in the bypass line 240. In addition, the first flap 250 is rotatably provided in the intake and exhaust block 200, thereby covering the supply hole 224 or the bypass hole 244 depending on a rotational angle thereof. Therefore, when the first flap 250 is maximally rotated counterclockwise, the bypass hole 244 is covered by the first flap 250 so that the bypass line 240 is closed as shown in FIG. 3. In contrast, when the first flap 250 is maximally rotated clockwise, the supply hole 224 is covered by the first flap 250 so that the supply line 220 is closed as shown in FIG. 5.

Likewise, in order to ensure effective closing of the second flap 440 regarding any one of the re-cooling line 420 and the release line 430, a re-cooling partition 422 having a re-cooling hole 424 is provided in the re-cooling line 420, and a release partition 432 having a release hole 434 is provided in the release line 430. In addition, the second flap 440 is rotatably provided in the U-turn block 400 to cover the re-cooling hole 424 or the release hole 434 depending on a rotational angle thereof. Therefore, when the second flap 440 is maximally rotated clockwise, the release hole 434 is covered by the second flap 440 so that the release line 430 is closed as shown in FIG. 3. In contrast, when the second flap 440 is maximally rotated counterclockwise, the re-cooling hole 424 is covered by the second flap 440 so that the re-cooling line 420 is closed as shown in FIG. 4.

An exhaust gas cooling mode is determined by which lines are closed by the first flap 250 and the second flap. Hereinbelow, mode conversion due to operations of the first flap 250 and the second flap 440 will be described in detail.

In a cooling mode as shown in FIG. 3, the first flap 250 is maximally rotated counterclockwise to cover the bypass hole 244 and the second flap 440 is maximally rotated clockwise to cover the release hole 434. In this mode, exhaust gas flowing through the exhaust gas pipe 100 is maximally cooled.

That is, as shown in FIG. 3, when exhaust gas is supplied through the exhaust gas pipe 100 to the intake part 210 while the bypass line 240 and the release line 430 are closed, the exhaust gas flows along the supply line 220. Here, an outlet of the supply line 220 communicates only with some (in the embodiment, three upper gas tubes 310) of the plurality of gas tubes 310 provided in the cooler 300. Thus, the exhaust gas supplied to the cooler 300 through the supply line 220 is cooled while passing through the three upper gas tubes 310, and then enters the inflow part 410 of the U-turn block 400.

As shown in FIG. 3, since the U-turn block 400 is composed of the closed release line 430 and the opened re-cooling line 420, the exhaust gas flowing through the inflow part 410 is returned to the cooler 300 through the re-cooling line 420 and is cooled again. Here, an outlet of the re-cooling line 420 communicates only with the remaining gas tubes 310 (in the embodiment, five lower gas tubes 310) of the plurality of gas tubes 310 provided in the cooler 300. Accordingly, the exhaust gas supplied to the cooler 300 through the re-cooling line 420 is not interfered with by exhaust gas entering the U-turn block 400.

In addition, the exhaust gas that is cooled again while passing through the five lower gas tubes 310 is re-circulated to the engine through the discharge line 230. Here, a part of the exhaust gas flowing into the discharge line 230 may be returned to the U-turn block 400 through the air duct 500. However, since the release line 430 communicating with the air duct 500 is sealed by the second flap 440, backflow of exhaust gas does not occur.

Meanwhile, exhaust gas returned to the cooler 300 from the re-cooling line 420 is further cooled to a certain level rather than exhaust gas supplied to the cooler 300 from the supply line 220. Accordingly, in order to more reliably cool exhaust gas returned to the cooler 300 from the re-cooling line 420, it is preferable that contact area between the exhaust gas and the gas tubes 310 is increased. That is, it is preferable that the number of gas tubes 310 connected to the outlet of the re-cooling line 420 is designed to be larger than the number of gas tubes 310 connected to the outlet of the supply line 220.

In a semi-cooling mode as shown in FIG. 4, the first flap 250 is maximally rotated counterclockwise and covers the bypass hole 244, and the second flap 440 is also maximally rotated counterclockwise and covers the re-cooling hole 424. In this mode, exhaust gas supplied through the exhaust gas pipe 100 is cooled to a certain level.

That is, as shown in FIG. 4, exhaust gas is supplied to the intake part 210 through the exhaust gas pipe 100 while the bypass line 240 and the re-cooling line 420 are closed. Here, the exhaust gas is cooled to the certain level by passing through some (in the embodiment, three upper gas tubes 310) of the plurality of gas tubes 310 provided in the cooler 300. Then, the exhaust gas flows directly to the discharge line 230 through the release line 430 and the air duct 500 without being returned to the cooler 300. Accordingly, the exhaust gas flowing into the discharge line 230 through the release line 430 and the air duct 500 is re-circulated to the engine while maintaining the temperature higher than the temperature in the cooling mode in FIG. 3.

Therefore, when exhaust gas discharged from the engine needs to be slightly cooled and re-circulated to the engine, the exhaust gas heat exchanger of the present invention can be turned to the semi-cooling mode as shown in FIG. 4, and cool the exhaust gas to the certain level. Thus, situational NOx reduction effect can be maximized.

In a bypass mode as shown in FIG. 5, the first flap 250 is maximally rotated clockwise and covers the supply hole 224. This bypass mode is a cooling mode in which exhaust gas supplied through the exhaust gas pipe 100 is maximally cooled so as to be circulated to the engine after being bypassed without being cooled.

That is, exhaust gas is supplied to the intake part 210 through the exhaust gas pipe 100 while the supply line 220 is closed, as shown in FIG. 5. Thus, since the exhaust gas is bypassed to the outside of the intake and exhaust block 200 along the bypass line 240, the exhaust gas is re-circulated to the engine without any cooling process by the cooler 300. Here, the exhaust gas is not transferred toward the U-turn block 400 at all, and the exhaust gas can be bypassed regardless of which flow path is closed by the second flap 440.

In the above-described case in which exhaust gas discharged from an exhaust manifold of the engine is again bypassed to an intake manifold of the engine, when the temperature of the exhaust gas is not very high such as when the engine is started, the problem that CO and HC are discharged without being converted into harmless gas can be solved. In addition, the effect on the problem may be obtained by the same way when the conventional exhaust gas heat exchanger is used, and a detailed description thereof will be omitted.

Meanwhile, exhaust gas discharged to the outside of the intake and exhaust block 200 through an outlet of the discharge line 230 or an outlet of the bypass line 240 is supplied to the intake manifold of the engine through a separate transfer pipe (not shown). In order to supply both exhaust gases discharged from outlets of the discharge line 230 and the bypass line 240 to the intake manifold of the engine using one transfer pipe, it is preferable that the outlets of the discharge line 230 and the bypass line 240 are each formed as a semicircular-shaped cross-section of flow path so as to be coupled in a single pipe. Of course, the outlets of the discharge line 230 and the bypass line 240 should be separated by a discharge partition 232 so as not to directly communicate with each other.

Although a preferred embodiment of the present invention has been described for illustrative purposes, the scope of the present invention is not limited to the specific embodiment, but should be interpreted according to the accompanying claims. Those skilled in the art will appreciate that various modifications, additions and substitutions are possible, without departing from the scope and spirit of the invention as disclosed in the accompanying claims.

The invention claimed is:

1. An exhaust gas heat exchanger comprising:

a cooler through which cooling water flows and in which a plurality of gas tubes is provided to allow exhaust gas to flow;

an intake and exhaust block including an intake part to which an exhaust gas pipe for supplying exhaust gas is connected, a supply line for communicating first ends of some of the plurality of gas tubes with the intake part, a discharge line for communicating first ends of the remaining tubes of the plurality of gas tubes with outside, a bypass line for bypassing exhaust gas entering from the intake part to the outside, and a first flap for blocking selectively any one line of the supply line and the bypass line;

a U-turn block including an inflow part into which exhaust gas discharged through second ends of some of the plurality of gas tubes flows, a re-cooling line for communicating second ends of the remaining tubes of the plurality of gas tubes with the inflow part, a release line for discharging exhaust gas entering from the inflow part to the outside, and a second flap for blocking selectively any one line of the re-cooling line and the release line; and an air duct for guiding exhaust gas to the discharge line, the exhaust gas being discharged through the release line, wherein, a supply partition having a supply hole is provided in the supply line, a bypass partition having a bypass hole is provided in the bypass line, the first flap is rotatably mounted on the intake and exhaust block and is operated to cover the supply hole or the bypass hole depending on a rotational angle thereof, a re-cooling partition having a re-cooling hole is provided in the re-cooling line, a release partition having a release hole is provided in the release line, the second flap is rotatably mounted on the U-turn block and is operated to cover the re-cooling hole or the release hole depending on a rotational angle thereof, and outlets of the discharge line and the bypass line are integrally formed into a single pipe that is divided by a discharge partition.

2. The exhaust gas heat exchanger of claim 1, wherein number of the gas tubes connected to an outlet of the re-cooling line is larger than number of the gas tubes connected to an outlet of the supply line.

* * * * *